United States Patent [19]

Rinehart

[11] Patent Number: 4,733,870

[45] Date of Patent: Mar. 29, 1988

[54] STRATEGY GAME EMPHASIZING ECONOMICAL AND POLITICAL DEVELOPMENT

[76] Inventor: Ed Rinehart, 3311 Santa Rosa St., Colorado Springs, Colo. 80909

[21] Appl. No.: 903,399

[22] Filed: Sep. 3, 1986

[51] Int. Cl.[4] ..... A63F 3/00

[52] U.S. Cl. ..... 273/278

[58] Field of Search ..... 273/256, 278, 255, 262, 273/236, 242, 297, 243

[56] References Cited

U.S. PATENT DOCUMENTS

| | | | |
|---|---|---|---|
| 590,078 | 9/1897 | Turner | 273/278 |
| 4,266,775 | 5/1981 | Chitnis et al. | 273/278 |

FOREIGN PATENT DOCUMENTS

| | | | |
|---|---|---|---|
| WO81/01522 | 6/1981 | Int'l Pat. Institute | 273/278 |
| 2078118 | 1/1982 | United Kingdom | 273/256 |

*Primary Examiner*—Richard C. Pinkham
*Assistant Examiner*—Matthew L. Schneider
*Attorney, Agent, or Firm*—Timothy J. Martin

[57] ABSTRACT

A game apparatus for playing a strategic game of economic and political development includes a game board organized in a map format wherein ficticious continental regions are located in an ocean region. The continental regions are sub-divided into territories, and the map is overlaid with a gridwork of lines defining a matrix of sectors. The territories are distinguishably indexed and some of the territory are indexed with markings designating native resources. A set of territory cards indentify the territories, and a set of resource cards, some of which have additional resource designations, are in one-to-one correspondence with the territory cards. Each player has a scoresheet which accumulates point factors; each scoresheet is organized as a chart of point factor category rows which relate to developmental characteristics, and the rows are formed in sequential columns corresponding to rounds of play. Some of the point factor categories are correlated to one another and to the resource designations to define limits on point factor allocations. Chance event cards affect the point factor allocations which a player makes. A masking marker is used to block some sectors according to chance cards which also control battles between adversarial players with battles being registered on a separate battle sheet. Conflict modifier cards may be used to alter battle results, and monetary units are used to represent financial transactions.

20 Claims, 17 Drawing Figures

STRATEGY GAME EMPHASIZING ECONOMICAL AND POLITICAL DEVELOPMENT

BACKGROUND OF THE INVENTION

The present invention generally relates to games of strategy and particularly is directed to a geopolitical game of strategy emphasizing the complex interplay of a plurality of factors correlated to national development. This invention therefore, is specially adapted for a plurality of players who, as "heads of state" control the development and growth of imaginary nation states in an imaginary world. This game is accordingly, one of contemporary world economic strategy and power politics which parallels the mechanics of international relations in the real world and wherein the goal for each player is to negotiate survival and achieve the highest development for the player's nation as represented by a score of point factors representative of diplomacy and international problem solving.

Many games developed in the past are simple "race" games wherein each player somewhat independently pursues an objective with the first player reaching the objective winning the game. Various obstacles are placed in the path of the players which must be overcome in reaching the goal and, in some instances, these games have some interaction among the player's game pieces. Other typical games developed in the past include attack and capture games wherein each player pursues a basic predatory course of play in an effort to eliminate each of the other players through strategic skill or as a result of random chance.

Some games developed in the past have sought to expand on these two rather simple concepts in structuring a gaming environment which causes the players to interact with one another in a more political arena. Even these games of cooperative self-interest are directed to military strategy, independent of the fundamental underpinnings of a social, industrial, technology and economic development which are precursors to military capabilities. More specifically, these existing games stress the success of military operations as the primary goal of the game rather than the use of military force as a last means of conflict resolution.

The present invention, then, expands upon the interplay among the participants by creating an environment wherein the players are placed within a world model and are forced to develop respective nation states through cooperative self-interest influenced by both controllable and random events. Thus, the present invention more closely models the macrocosm of the real world rather than the microcosm of simple military deployment. Even though the geopolitical strategy game described in this invention still places the participant in adversarial roles, the present game does not isolate either the actions taken by each player or each player's strategy. Rather, the present game fosters the interplay of actions and strategies.

SUMMARY OF THE INVENTION

It is an object of the present invention to provide a new and useful game of geopolitical development which models the growth and interrelationship of nation states existing in an imaginary world.

It is another object of the present invention which models international relations in the real world yet which is set in an imaginary world.

It is another object of the present invention to provide a game apparatus wherein each of a plurality of players controls the growth of a respective nation state from basic fundamentals to develop advanced national entities which compete in an international arena.

It is yet another object of the present invention to provide a game which teaches the interrelationship of complex social, economic and political factors in international policies and procedures.

A still further object of the present invention is to provide a game apparatus which teaches the pursuit of cooperative self-interest through negotiation in a political science setting.

The geopolitical game according to the present invention is constructed as a simulation of the "real world" which is accomplished by identifying and integrating primary elements of the world condition into a workable game format controlled by specific game mechanics. These primary elements include geography, economics, politics, military force, social/cultural aspects, and unexpected events. These elements define point factor categories which measure the success of each individual player thereby displaying each player's success at the end of a sequence of game rounds.

In its broadest form, the present invention is structured as a game board which has an upper surface organized in a map format wherein a plurality of geographic regions are separated into a plurality of territories indexed to be distinguishable from one another. A grid work is formed on the upper surface of the game board and overlaps the geographic regions, with the grid work being formed by a plurality of first lines in spaced parallel relation to one another and a plurality of second lines also in spaced parallel relation to one another but perpendicular to the first set of lines. This grid thus defines a matrix of sectors on the game board which sectors correspond to relative transportation distances. A first chance means, preferably in the form of a deck of "territory" cards, is provided for allocating a territory to each of the players in order to define a home base or home nation for the respective player. Means for designating resource characteristics for some of the territories is provided, with this designation means preferably being a second deck of "resource" cards in one-to-one correspondence with the territory cards. Thus, as each player acquires territories in addition to his or her home base, the "resource" cards allocate additional resources to that territory. In order to keep track of each player's process, a plurality of score sheets is provided, there being a respective score sheet for each respective player. Each score sheet is organized as a chart having a plurality of rows indexed with a development category adapted to receive point factor allocations obtained by a respective player and further organized as a plurality of sequential columns adapted to receive and accumulate point factor allocations for successive rounds of plays. The score sheet is further interrelated to the game board and the designation means by having at least some of the categories correlated to the resource characteristics. A chance event means is provided for carrying instructions which influence each player's point factor allocations on respective rounds of plays with respect to categories which are indexed by the chance event means. Preferably, the chance event means is in the form of a third deck of "chance event" cards which are marked with random natural, political, social and economic events which introduce unexpected windfalls or catastrophies in the development of each player's nation state as evidenced by his or her score sheet.

In order to further model the effect of natural events, the preferred embodiment of the present invention includes a marker which is adapted to be placed on the surface of the game board and is movable across the matrix of the sectors. This marker is sized to mask a selected number of sectors as it moves therealong, and a second chance means for controlling the movement of the marker is provided to determine its position for each successive round of play. The location of the marker with respect to the geographical territories affects the ability of each player to have transportation access to or through masked sectors.

In order to introduce further realism into the preferred embodiment of the present invention, a plurality of record sheets are provided with each record sheet being marked with instruction correlated to at least one of the resource categories wherein a player may designate factors on his or her score sheet for use in confronting another player. After confronting players designate factors to be used in a specific conflict, chance event means are provided for determining the outcome of the conflict which results in altering the point vector accumulations on the score sheet of each respective confronting player.

In the preferred form of the present invention, the game board is formatted as a distribution of continental regions within a ocean region. The continental regions are broken by territorial boundaries which separate them into the geographical "nations" which are then indexed by fictitious names. A plurality of island regions are located on the map within the oceanic regions. Means representing monetary strength are also included. A card which is marked with an instruction to end the game is included in the chance event means deck of cards so that, when the card is exposed, at a random time, the game is terminated.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to a geopolitical game which is organized and constructed as a gaming apparatus having a variety of interrelated parts, each of which is described below. While it is to be appreciated from the outset that the format of this game is described as an imaginary world, in map format, the principles set forth with respect to this game may be utilized on a variety of different representative game boards so long as the basic interrelationships among the elements of the game apparatus are maintained. Broadly, the game equipment according to the preferred embodiment of the present invention, comprises: a game board, five decks of cards, an intense storm marker, player score sheets, battle record sheets, and monetary units.

Figure 1:
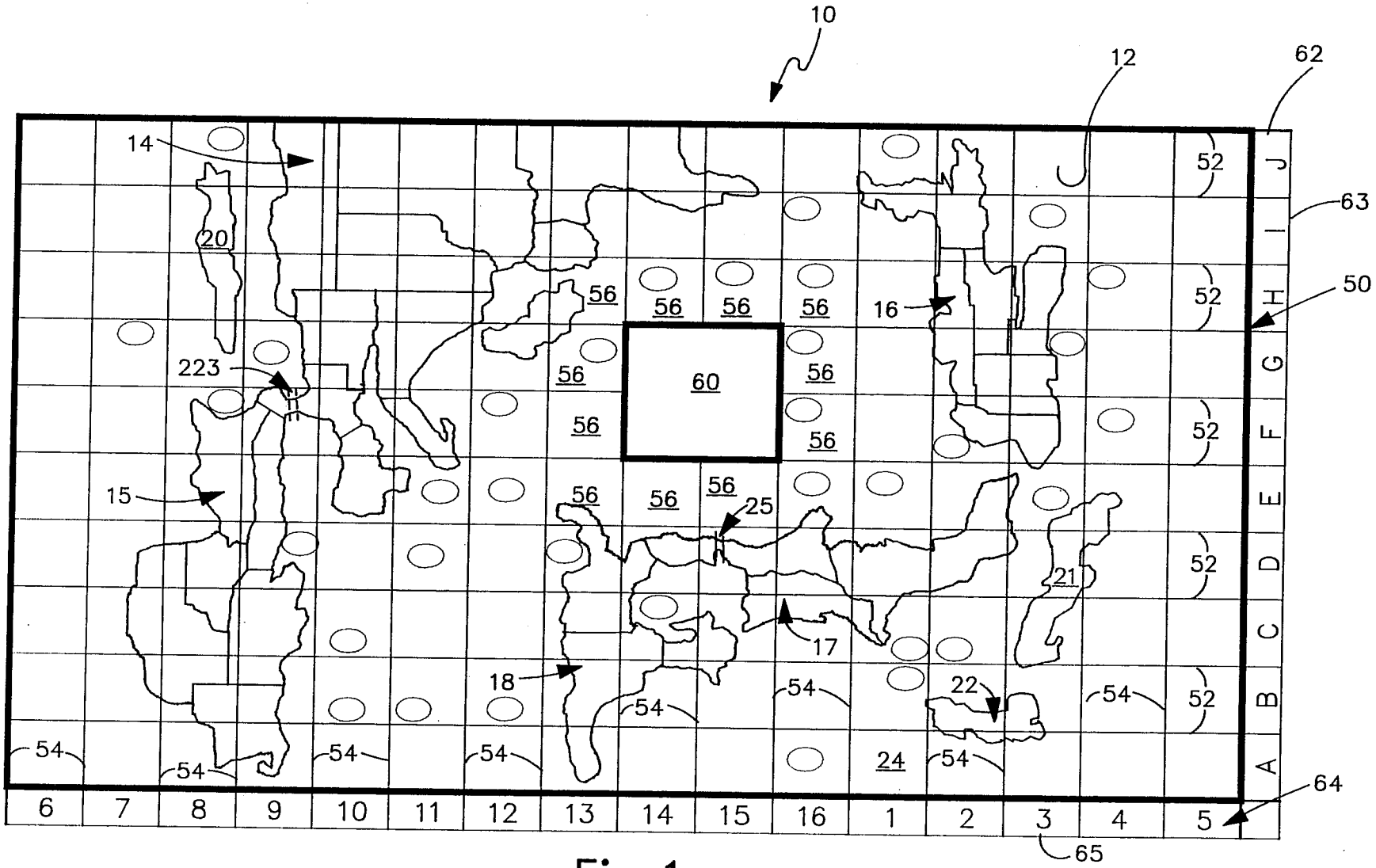
FIG. 1 is a top plan view of the game board according to the present invention.
Figure 2:
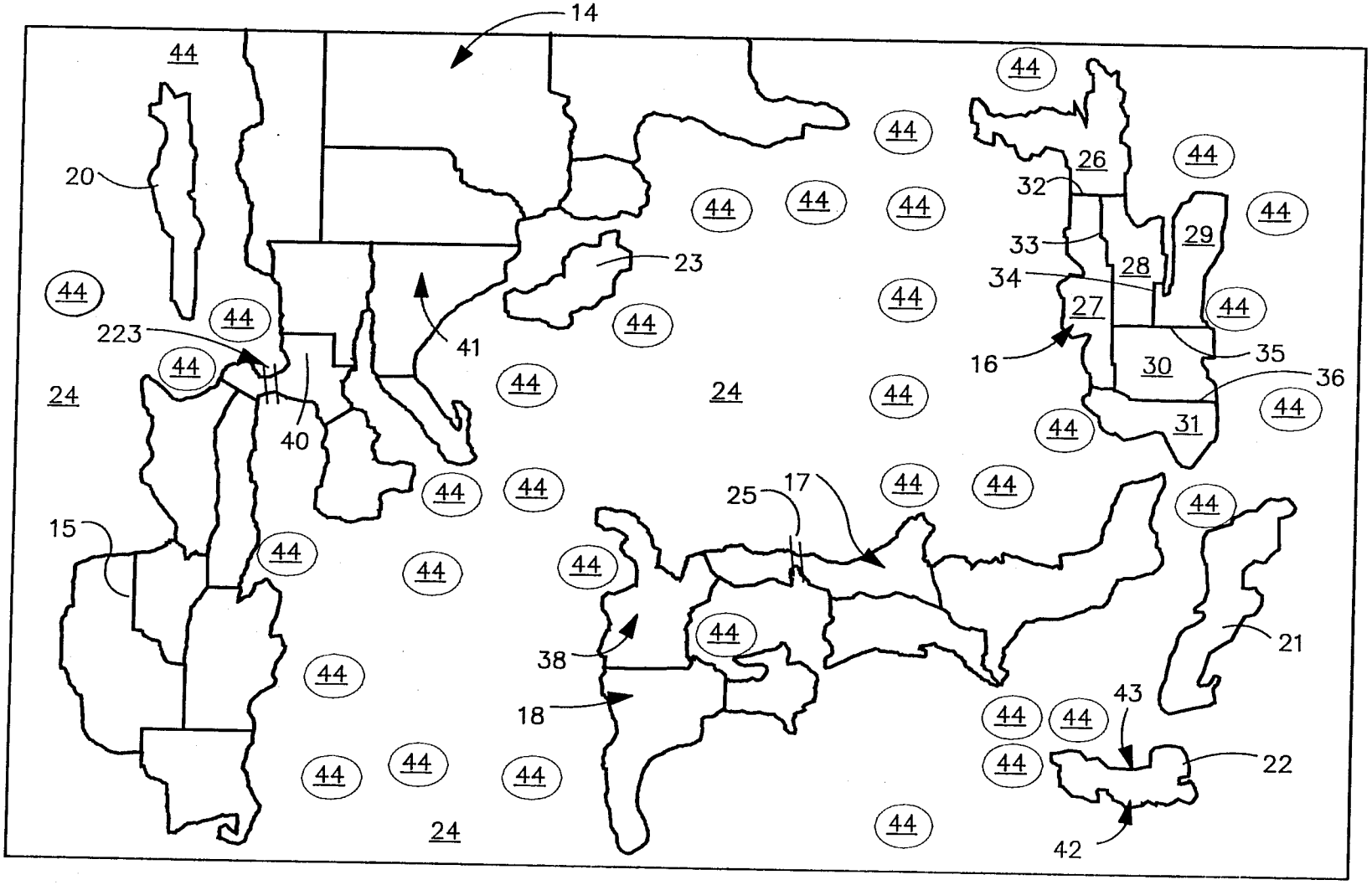
FIG. 2 is a top plan view of the game board shown in FIG. 1 without the transportation grid.

Specifically, as is shown in FIGS. 1 and 2, game board 10 has an upper surface 12 organized in a ficticious map format including continental regions 14–18 and large island regions 20–23. Each of continental regions 14–18 as well as island regions 20–23 are located within an ocean region 24. Each of continental regions 14–18 are separated into a plurality of territories by means of boundary lines. By way of example, continental region 16 is separated into territories 26–31 by boundary lines 32–36; continental regions 14, 15, 17 and 18 are similarly separated into territories or "nations". Islands 20–23 are represented as singular nations or territories, each of which being indexed to be distinguishable from one another. For example, indexed names 38–40 in continental region 18, names 40 and 41 in continental region 14, and name marking 42 indexed to island region 22. A plurality of small island regions 44 are interspersed throughout ocean 24. Canals 223 and 25 extend through the isthmusi between regions 14 and 15 and between regions 17 and 18, respectively.

As is shown in FIG. 1, surface 12 of game board 10 is also overlayed by a transportation grid 50 formed by a plurality of first lines such as lines 52 which are oriented in uniformly spaced, parallel relation to one another. A second set of lines 54 are all oriented perpendicularly to lines 52 and are also in uniformly spaced parallel relation to one another. Accordingly, surface 12 is divided by a plurality of sectors, such as sectors 56 which are organized as a matrix, which, as shown in FIG. 1, is a matrix of ten rows and sixteen columns. Preferably, game board 10 is contructed as a relatively rigid foldable game board, as is known in the art.

Figure 3:
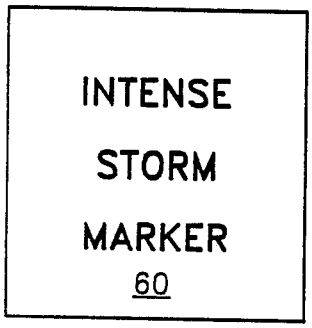
FIG. 3 is a perspective view of the intense storm marker according to the preferred embodiment of the present invention.
Figure 4A:
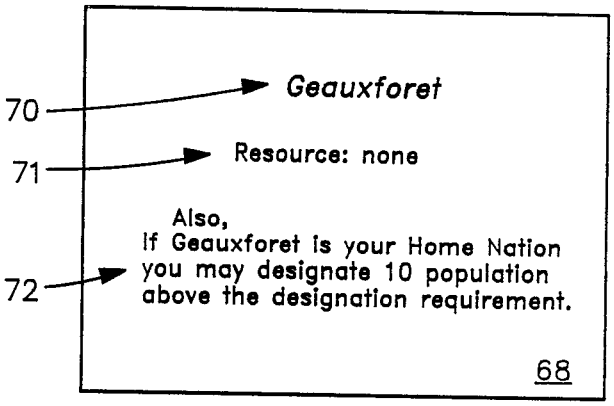
FIGS. 4*a*, 4*b* and 4*c* are illustrative of a first type of chance card, namely the "nation" cards forming part of this invention.
Figure 4B:
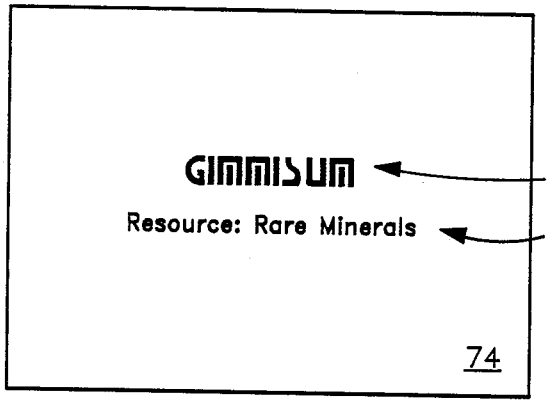
Figure 4C:
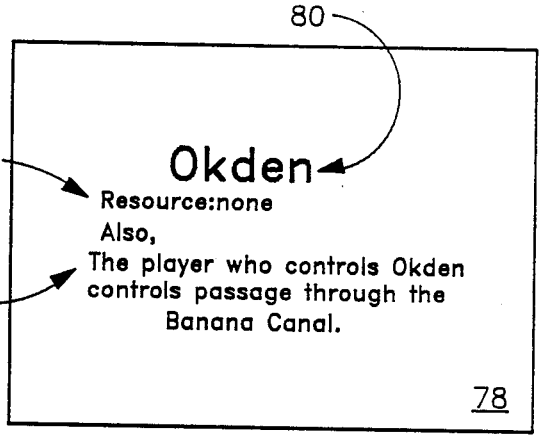
Figure 5A:
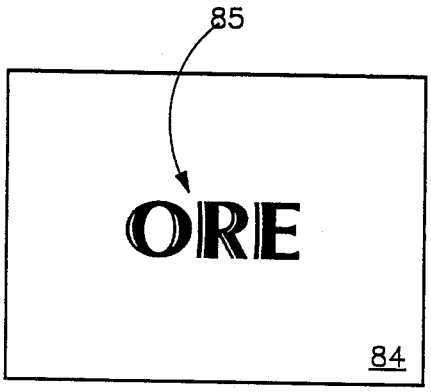
FIGS. 5*a* and 5*b* are illustrative of a second type of card, namely the "resource" card forming part of the present invention.
Figure 5B:
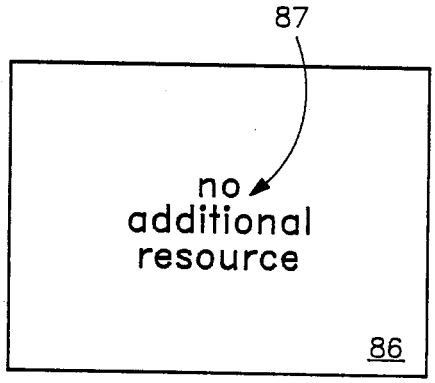

A cardboard marker 60, shown in FIG. 3, may be positioned on game board 10, as is shown in FIG. 1. Cardboard marker 60 defines an "Intense Storm Marker" and is sized so that it covers a plurality of sectors 56. Marker 60 is movable along surface 12 of game board 10 in order to mask selected sectors 56. In order to locate the position of islands 44, and to determine the movement of marker 60, the rows of sectors 56 are marked along the edge of game board 10 by alphabetical indexing 62, while the columns of sectors 56 are indexed by numerical indexing 64 along edge 65 of game board 10. It should be appreciated that only a single island 44 is oriented within any single sector 56.

In order to allocate an initial home territory or home base for a respective player, first chance means is provided in the form of a deck of cards in one-to-one correspondence with the number of territories formed on game board 10. Representative examples of these territory cards are shown in FIGS. *4a–4c*. In each of these illustrative figures, a territory indexing is provided, a resource indexing corresponding to the territory, and an optional control instruction is provided which is directed to specific qualities of the respective territory.

For example, in FIG. *4a*, territory card 68 corresponds to the territory "Geauxforet" by territory marking 70. Card 68 corresponds to the territory designated by territory name 41 shown in FIG. 2. Since this territory does not have any native resource, resource marking 71 indicates the absence of native resource in "Geauxforet". Instruction marking 72 is a control statement which affects certain point factors which may be designated with respect to this territory, as is described more thoroughly below.

FIG. *4b* shows territory card 74 which has territory index 76 which corresponds to the territory "Gimmisum" and resource marking 77 indicates that this territory has a native resource of "rare minerals". Index marking 76 of card 74 correlates card 74 to the territory name 42 shown in FIG. 2, and it should be appreciated that resource marking 43 is located within territory 22. Resource marking 43 is permanently enscribed on game board 10 corresponding to resource marking 77 on territory card 74.

In FIG. *4c*, territory card 78 includes a territory marking 80 which corresponds to territory name 40 on game board 10 shown in FIG. 2. Since no native resource is located in this territory, resource marking 81 so indicates, and a control statement 82 is provided, for example, to indicate that the owner of this territory controls seaway passage through canal 223 located in this territory. In the preferred embodiment of the present invention, thirty-two territories, such as territories 26–31 are provided; accordingly, thirty-two territory cards, such as cards 68, 74 and 80 are utilized in the gaming apparatus. These territory cards are in one-to-one correspondence with the territories shown on game board 10.

FIGS. *5a* and *5b* are representative samples of a second type of a card which forms a part of the present invention. These two figures shown "resource" cards and can either be resource card 84 which has a resource indication 85, or can be a resource card 86 having an indication of no additional resource formed as resource indication 87, respectively shown in FIGS. *5a* and *5b*, with resource marking 85 being in the form of "ore". Resource cards such as cards 84 and 86 are in one-to-one correspondence with the territory cards so that, when receiving a territory card, a player simultaneously receives a resource card to randomly designate additonal resources to select ones of the territories. For example, even though the territory "Geauxforet" has no native resource, a player receiving resource card 84 sinultaneously with territory card 68, obtains a native resource in the form of "ore". If desired, one or more extra resource cards can be inserted in the set of resource cards to prevent a player from determining the remaining resource card by reviewing the previously exposed resource cards.

Accordingly, it should be appreciated that index markings such as resource marking 43 as well as resource cards, such as cards 84 and 86, form designation means for assigning resource characteristics to some of the territories defined on game board 10. Resource markings 43 are permanently designated resources for a specific territory, cross-referenced to the territory cards, and resource cards 84 provide a random resource designating means. Further, it should be appreciated that resource cards, such as cards 84 and 86, may be conveniently designated with resources "ore", "rare minerals", "oil", "coal" or other designations, as convenient.

Figure 7:
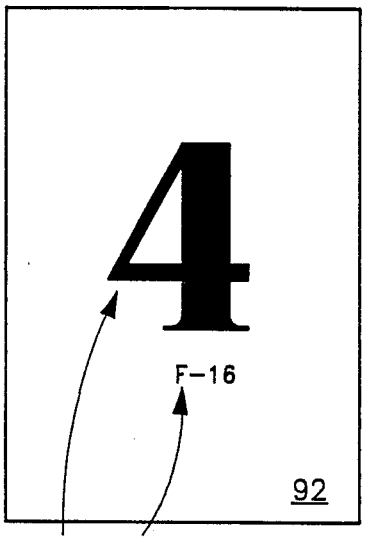
FIG. 7 is illustrative of one type of chance card employed, namely the "conflict resolution" card forming part of the present invention.
Figure 6B:
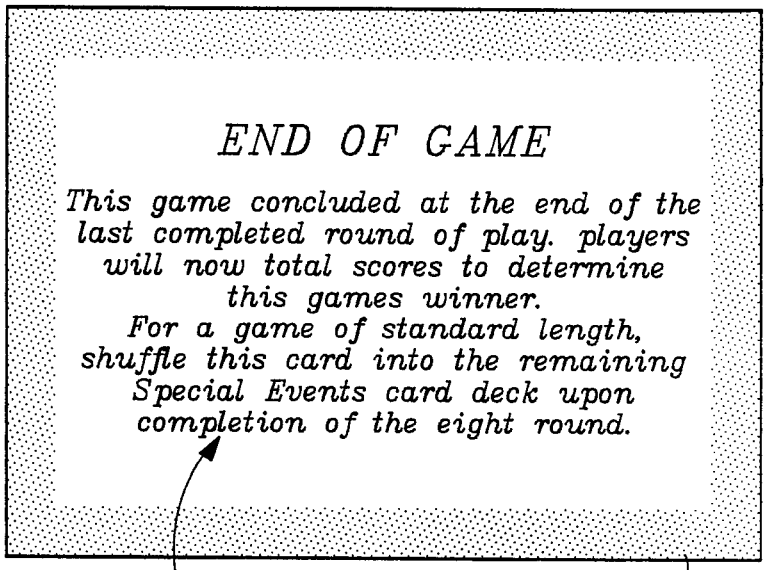
FIGS. 6*a* and 6*b* are illustrative of a third type of chance card, namely the "chance event" card.
Figure 6A:
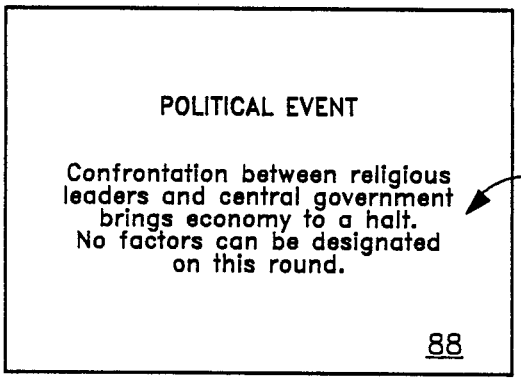
Figure 8:
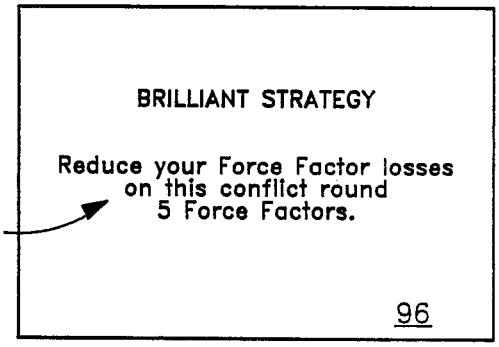
FIG. 8 is illustrative of a fourth type of card, namely the "conflict modifier" card according to the present invention.
Figure 9:
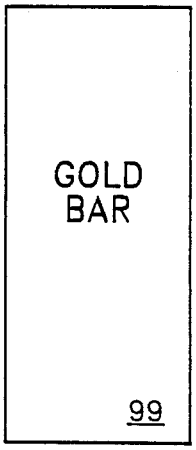
FIG. 9 is illustrative of a monetary unit, namely, a "gold bar" according to the present invention.

FIGS. *6a* and *6b* shown chance event means in the form of cards 88 and 90. Each of cards 88 is provided with an instruction 89 that provides an instruction to control point factor designations for a specific player who draws the chance event card. Chance event card 90 is provided to end the game, and instruction 91 is stated for that purpose. A second chance event means is shown in FIG. 7 and comprises "conflict resolution" cards such as card 92 which contains a numerical value marked thereon such as the numerical marking "4" designated at 93. In addition, each of these cards is designated with a sector marking 94 which corresponds to a location of one of islands 44 indexed by row and column indexing 62 and 64. FIG. 8 shows a representative "conflict modifier" card 96 containing a modifying instruction 98 which influences the outcome of a military conflict between two or more players. FIG. 9 shows a monetary unit card 99, indexed as a "Gold Bar".

Figure 10A:
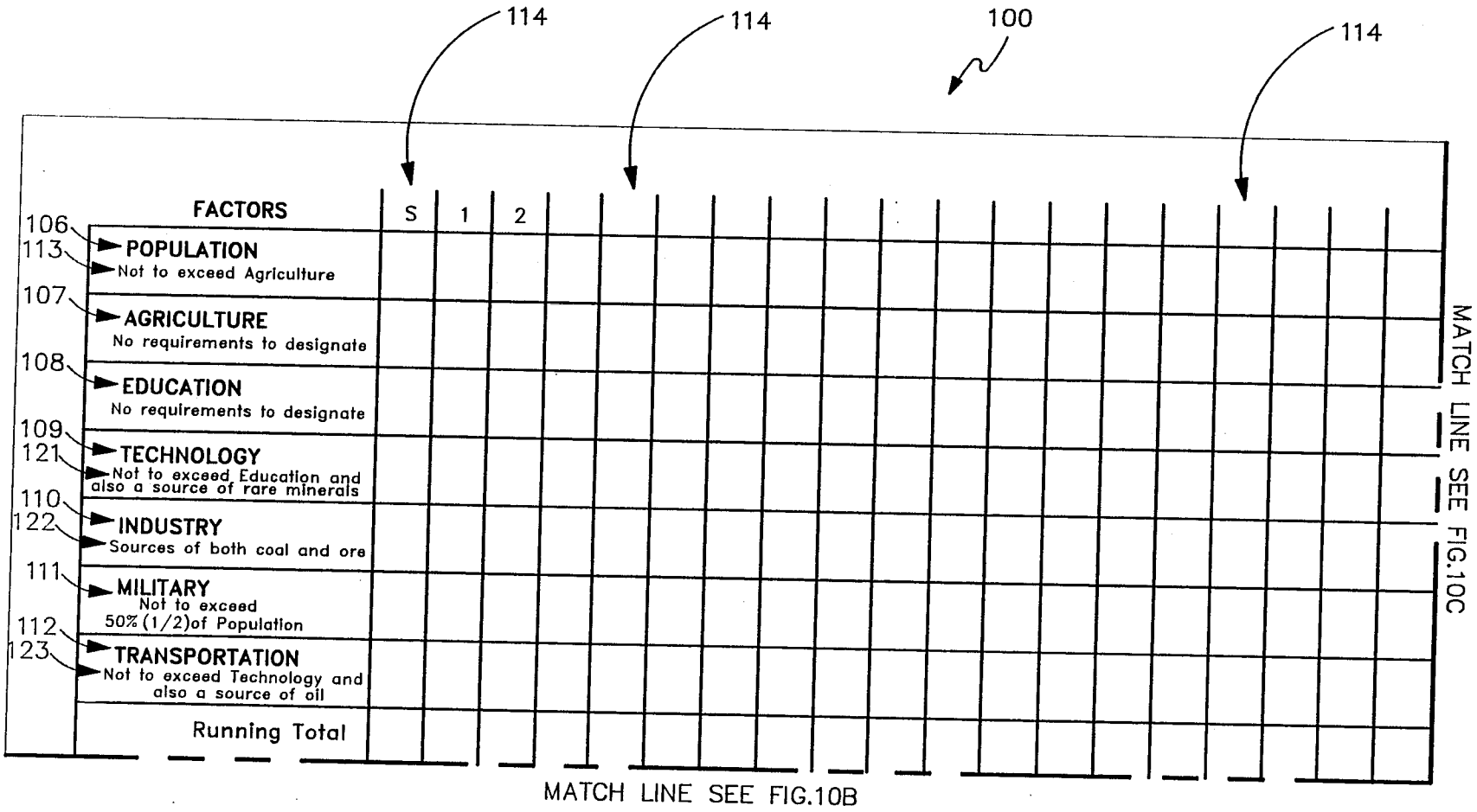
FIGS. 10A, 10B, and 10C is a top plan view of a score sheet according to the present invention.
Figure 10B:
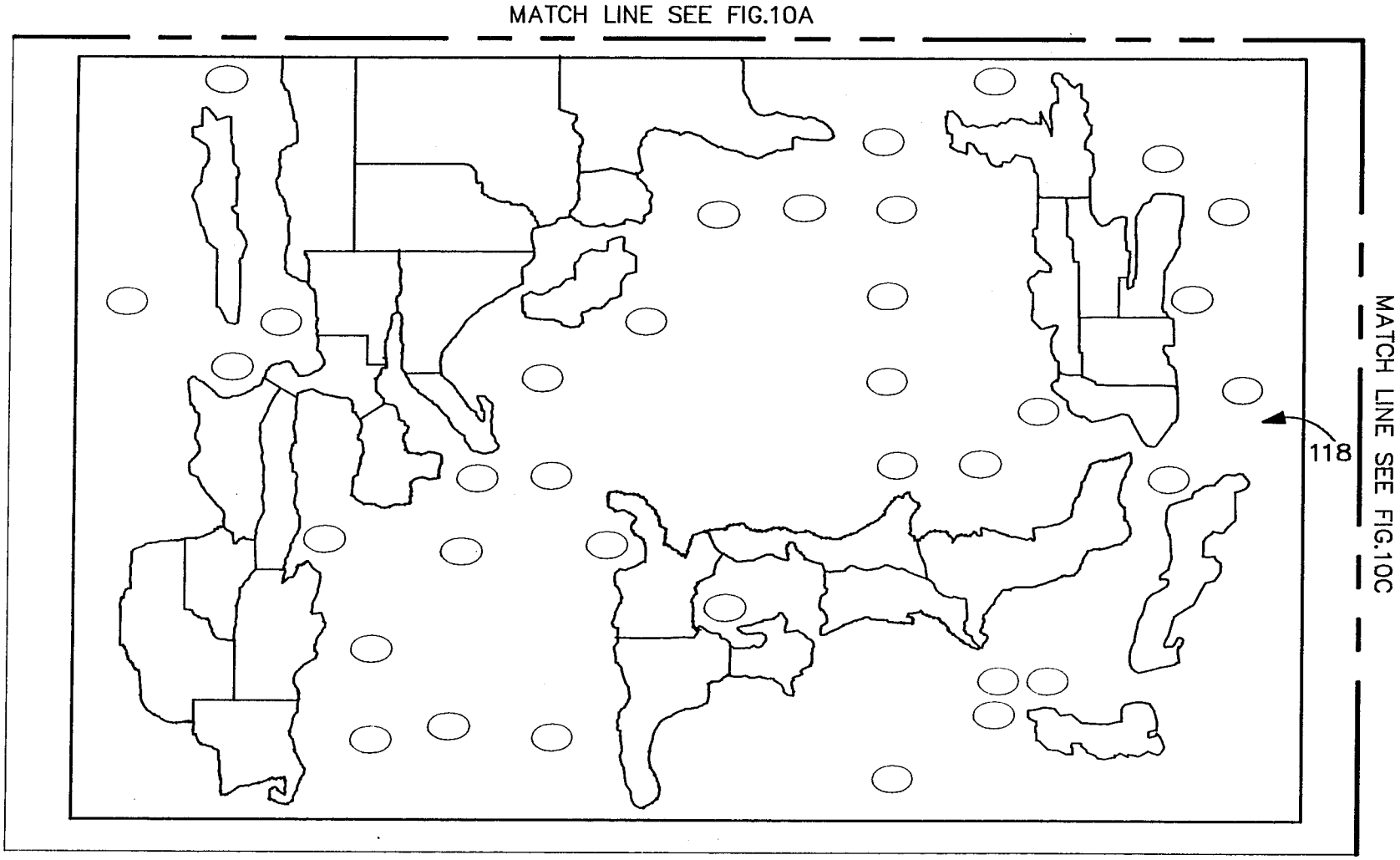
Figure 10C:
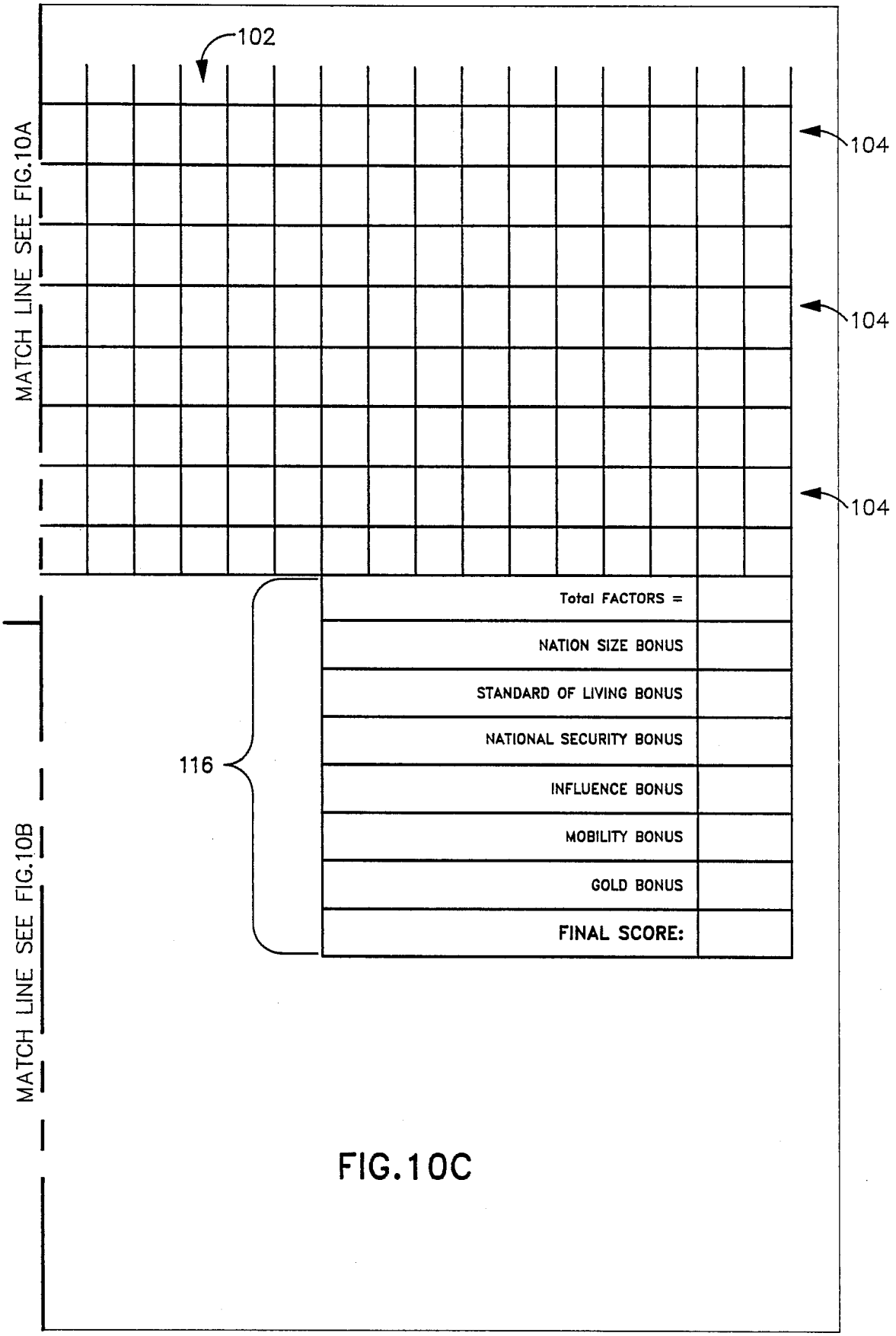

Before turning to an explanation of the start of the strategic geopolitic game according to the present invention, it is first helpful to consider the structure of score sheet 100 shown in FIGS. 10A, 10B and 10C. As is shown in FIGS. 10A, 10B and 10C, each score sheet 100 includes a chart 102 organized as a plurality of rows 104 each of which is indexed with a primary element of national strength conveniently referred to as "factor" categories. For example, score sheet 100 includes seven factor categories 106 through 112 which are respectively marked as: (a) population 106; (b) agriculture 107; (c) education 108; (d) technology 109; (e) industry 110; (f) military 111; and (g) transportation 112. In addition, it can be seen in FIG. 7 that some of categories 106–112 are cross-referenced to one another and some of which are correlated to the resource characteristics described above. For example, population index 106 is directly correlated by statement 113 to agriculture index 107 so that the point factor designations to be made of population cannot exceed the agricultural capabilities designated with respect to the agriculture factor 107. Further, in order to designate factor points for industry factor 110, the player must have both a source of coal and ore as a resource capability as indicated by statement 122. Rows 104 are then separated into a plurality of columns 114 which correspond to consecutive rounds of play, as described below. Score sheet 100 includes a total tabulation chart 116 and also includes a representative map 118 which reproduces game board 10 without grid 50.

The initial start up and play for the geopolitical strategy game according to the present invention may now be described with greater particularity. At the outset, it should be appreciated that the present game does not include normal playing pieces, but is rather a statistical game accumulated by each score sheet 100. At the start of each game, a single conflict resolution, such as card 92 is dealt and the grid coordinate 94 is observed to determine the location of one of islands 44 which is hereinafter referred to as "Gold Island". Marker 60 is placed over sector 56 located at E,F-14,15. Each player then receives a single territory card with this card then identifying each player's home nation. The remaining territory cards are placed face up on the playing surface. Each player also receives a single resource card, such as resource cards 84 or 86 which indicate additional resources, if any, that correspond to the player's home nation. Each player then records his/her home nation on a score sheet and also records all of the other player's home nations on map 118. Each player also indicates any additional resource received from the initial resource cards for each respective player by indicating the resource on map 118 within the respective territory. In addition, each player receives two monetary units in the form gold bars 99.

After being assigned a home nation and, possibly, additional resources, a player designates a preselected number of start up point factors in the first of columns 114, with the designation of start up factors (preferably thirty point factors) while always obeying the cross-referencing instructions shown with respect to factor categories 106–112. For example, in the start up round, a player cannot normally designate a greater number as a population factor than that player can designate as an agriculture factor. However, a player may receive a territory which allows modification of the ordinarily permitted designation requirement of score sheet 100. For example, should a player's home nation be "Geauxforet" as indicated by territory card 68, the player may designate population factors in excess of the agricultural factors. As is shown in FIG. 10, a sample designation includes ten points each for "population" and "agriculture" and a designation of five points each for "education" and "military". A player may only designate "technology", "industry" and "transportation" factors only if the player has access to the necessary resources designated by instructions 121–123, respectively. Access to resources is either obtained by owning the resource as a native resource for the home territory, purchasing the resource from a player who controls the resource by the payment of a gold bar 99, or by negotiating for its use while simultaneously having the transportation capability to move the resource from its location to the home nation, as described below.

Each round of play begins by moving marker 60 by drawing two cards 92 to determine the number of sectors which the marker 60 moves in the direction of lines 52 and 54, respectively. Play then comprises three additional steps. In the first step, each player draws a special event card, such as chance event card 88. On the second step, each player adds a selected number of point factors, such as eight point factors, to his/her respective score sheet. When designating point factors, each player observes the designation requirement shown on the score sheet unless modified by the chance event card 88. For example, should a player receive a chance event card 88 which carries an instruction 89, the player is not able to add any point factors on the round that chance event card 88 is received. The third step in a round includes the election by each player of an "action option". Each player's action option may include the claiming of a territory or an island or the taking of a conflict option described below. At the conclusion of each action option, the round of play is finished and a new round begins with another placement of the intense storm marker.

In electing an action option, a player can only take action options to the extent that the player has some transportation capability; otherwise the player must "pass". To this end, once a player designates at least one point factor under the transportation category, the player has access to any continuous overland travel route that is not blocked by another player who desires access thereto. Further, a player having a transportation factor may travel two seaway sectors, and, if sufficient technology factors are designated, additional seaway sectors may be travelled as well. Travel through canals 223 and 25 are controlled by the country containing each canal's isthmus and allows direct seaway access between sectors.

Assuming a player has transportation capability, then, a player can choose to claim a single territory or an island in order to control resources in the claimed territory in order to control travel routes through the territory or to influence another player's strategy. Marker 60 normally prevents transportation through the masked sectors. A second action option is called a subversive action which each player can exercise only once during a game. This action option allows the aggressor, who must have the then current lowest total factor count in the game, to deal a single conflict resolution card 92 to the player who has the highest total factor count. The aggressor adds to his/her scoresheet point factors equalling three times the number as shown on card 92; the defender subtracts point factors equalling three times the number shown on the card 92. The third type of action option is a conflict of either a limited or general nature and represents the exercise of military force.

Figure 11:
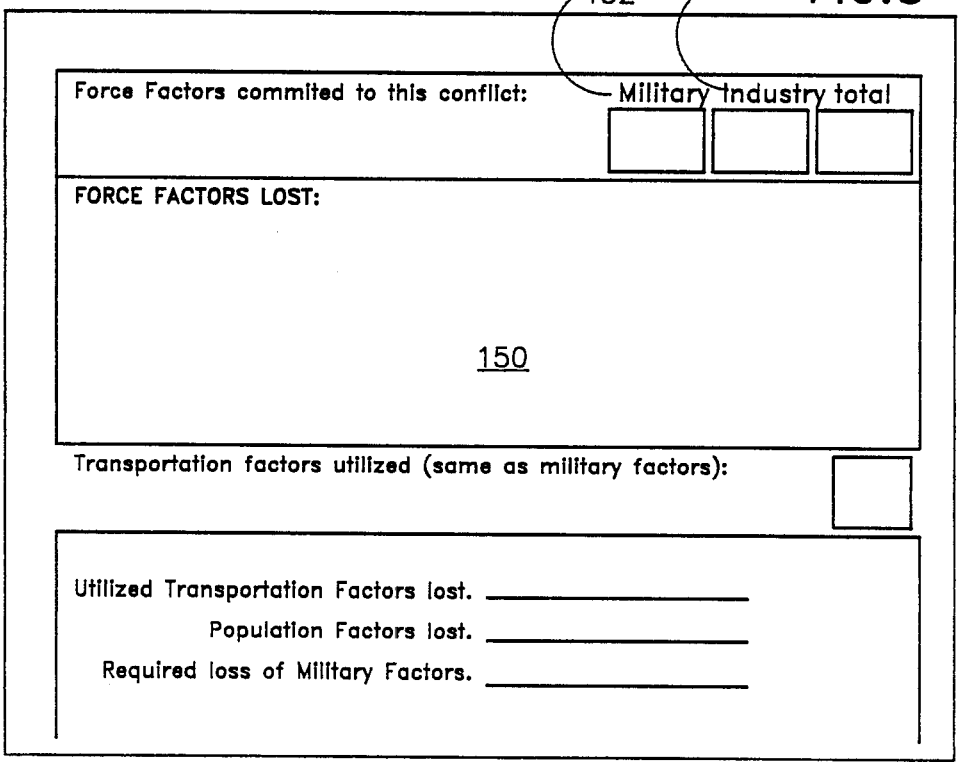
FIG. 11 is a top plan view of a "battle record" sheet according to the present invention.

In order to understand a conflict action, reference is made to FIG. 11 which shows a battle record sheet. A battle record sheet 150 is indexed to the resource categories of military and industry which are referred to as force factors, as is shown as indications 152 and 154 on sheet 150, respectively. The aggressor player must designate at least five force fctors on the battle record and must commit at least one military factor. The defending player must commit at least one military factor. Both players must have travel capability to and from their home nation to the location of conflict. The aggressor then deals one conflict resolution card 92 to the defender and one to himself. The number 93 on card 92 for each card represents the first factor losses incurred by each player. The conflict ends when either the defender or the aggressor loses all committed military factors or within three conflict rounds.

In order to hasten the resolution of a conflict, either player may elect to draw a conflict modifier card 96 so that the instruction 98 interacts with the loss 93 shown on conflict card 92 in order to alter the outcome. A general conflict may be engaged as an all-out battle between an agressor and a defender, and any additional players may form alliances with either the agressor or the defender. Conflict resolution cards 92 are dealt by the primary agressor against each defender, in the manner described above, and by each secondary agressor against each defender, in the manner described above. The general conflict is over if the primary agressor withdraws or if either the primary agressor or the primary defendor has lost all committed military factors.

A player who controls "Gold Island" at the end of each fifth round of play receives bonus gold bars 99 which accumulate until a player captures "Gold Island". After the eighth round, end of game card 90 is inserted into the chance event cards, and, upon being drawn by a player, card 90 ends the game effective as of the previous round. All points are then accumulated in table 116 and the prevailing order of players is determined by the highest point count.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A game apparatus for use by a plurality of players in playing a game as a sequence of rounds and scored by total point factors obtained by each player, comprising:

a game board with an upper surface organized in a map format having a plurality of geographic regions separated by boundary lines into a plurality of territories indexed to be distinguishable from one another and having a gridwork on the upper surface formed by a plurality of first and second lines intersecting one another to define a matrix of sectors;

designation means for indicating that a resource characteristic is associated with some of said territories;

first chance means for allocating one of said territories to each of said players to define a home base for a respective player;

a plurality of scoresheets, there being a respective scoresheet for each respective player, each of said scoresheets organized as a chart having a plurality of rows each of which is indexed with a developmental category and adapted to receive point factor allocations obtained by the respective player, said rows having a plurality of sequential columns adapted to receive point factor allocations for each row on successive rounds of play, some of said developmental categories being correlated to said resource characteristics; and chance event means carrying instructions for affecting the players' point factor allocations on a respective round of play with respect to at least one of said categories.

2. A game apparatus according to claim 1 wherein said designation means includes resource markings on the surface of said game board within some of said territories to permanently assign selected resource characteristics to the respective selected territory.

3. A game apparatus according to claim 1 wherein said first chance means is defined by territory cards, there being a respective territory card for each territory and having indexing correlating a respective territory card to its respective territory.

4. A game apparatus according to claim 3 wherein said designation means includes a plurality of resource cards, some of which are marked with resource characteristics and the remaining ones of which are marked to indicate the absence of a resource characteristic, there being at least as many resource cards as said territory cards.

5. A game apparatus according to claim 3 wherein some of said territory cards have instructions affecting point allocations correlated to said categories.

6. A game apparatus according to claim 1 wherein said chance event means includes a plurality of first event cards each having instructions marked thereon and indexed to at least one of said categories whereby said first event cards affect the point factors allocated by a respective player.

7. A game apparatus according to claim 6 wherein said chance event means includes an end card marked with an instruction to end the game.

8. A game apparatus according to claim 1 including a marker adapted to be placed on the surface of said game board and movable therealong, said marker sized to cover at least one of said sectors and including second chance means for controlling movement of said marker.

9. A game apparatus according to claim 1 wherein at least some of said developmental categories are marked with cross-referencing instructions requiring a point allocation interrelationship between the respective developmental categories.

10. A game apparatus according to claim 1 including a plurality of record sheets marked with instructions correlated to at least one of said categories whereby adversarial players may designate point factors allocated on said score sheet, said adversarial players being placed in conflict and including conflict resolution chance means for indicating lost point factors to be deducted from said record sheet, the accumulated losses of point factors on said record sheet being deleted from the player's respective record sheet.

11. A game apparatus according to claim 10 wherein said conflict resolution means includes a plurality of cards having various numeric values.

12. A game apparatus according to claim 10 including a plurality of conflict modifier cards having instructions operative to modify the effect of said conflict resolution means.

13. A game apparatus according to claim 1 wherein said scoresheet includes a map region substantially similar to the map format of the geographic regions of said game board.

14. A game apparatus for use by a plurality of players in playing a strategic geopolitical game as a sequence of rounds and scored by accumulated point factors obtained by each player, comprising:

a game board having an upper surface organized as a geographic map including continental regions surrounded by an ocean region, each said continental region further divisioned by boundary lines into a plurality of territories labelled by distinguishing markings and at least some of said territories marked with first resource category markings indicating native resources, the upper surface including a gridwork formed by first and second lines separating said map into a matrix of sectors indicative of transportation factors;

a set of territory cards each one of which being indexed to a respective one of said territories;

a set of resource cards with at least some of said resource cards labelled with second resource category markings for designating additional native resources for respective ones of said territories, there being at least one resource card for every territory card;

a plurality of scoresheets, there being a scoresheet for each player, each scoresheet organized as a chart having rows indexed to point categories adapted to receive allocations of said point factors, each row divisioned into columns representing successive rounds to be played, said rows further being marked to correlate some of said point categories to said first and second resource category markings; and a set of chance event cards correlated to said point categories for influencing a player's point factor allocation during a respective round.

15. A game apparatus according to claim 14 including battle record sheets marked with some of said point categories whereby adversarial players can each allocate point factors from a respective scoresheet onto said battle record sheet, and including a plurality of conflict resolution cards indexed with various numerical values for indicating point factors to be deducted from a respective battle record sheet, the accumulated losses on each battle record sheet being transposable onto a respective scoresheet.

16. A game apparatus according to claim 15 wherein said geographic map includes island regions within selected ones of said sectors, said grid being indexed with reference keys for locating said sectors, said conflict resolution cards having reference key markings thereon correlated to the selected sectors containing the island regions.

17. A game apparatus according to claim 14 including an intense storm marker positionable on said upper surface and sized to mask selected ones of said sectors to influence said transportation factors.

18. A game apparatus according to claim 14 wherein said scoresheet includes a map corresponding to the geographic map on said gameboard and further including a cumulative table for said point factors allocated on said chart.

19. A game apparatus according to claim 14 including a set of monetary cards each representing a unit of monetary exchange.

20. A game apparatus according to claim 14 including a canal passageway through at least one of said continental regions.

* * * * *